United States Patent [19]

Pugh et al.

[11] 4,097,040

[45] Jun. 27, 1978

[54] MULTIPLE SIZE ENVELOPE FEEDER

[75] Inventors: Gary L. Pugh, Kansas City, Mo.; Glenford Rowlett, Prairie Village, Kans.

[73] Assignee: Stephens Industries, Inc., Lenexa, Kans.

[21] Appl. No.: 736,448

[22] Filed: Oct. 28, 1976

[51] Int. Cl.[2] ..... B65H 3/08; B65H 3/56

[52] U.S. Cl. ..... 271/104; 271/12; 271/30 A; 271/106; 271/107; 271/149

[58] Field of Search ..... 271/30 A, 104, 20, 149, 271/150, 12, 14, 11, 107, 106, 2; 214/8.5 D, 1 M

[56] References Cited

U.S. PATENT DOCUMENTS

| | | | |
|---|---|---|---|
| 1,290,509 | 1/1919 | Chandler | 271/30 A X |
| 1,861,605 | 6/1932 | Maass | 271/104 |
| 2,792,218 | 5/1957 | Van Marle | 271/30 A X |
| 3,269,724 | 8/1966 | Lefief | 271/107 |
| 3,287,011 | 11/1966 | Currie | 271/12 |
| 3,313,537 | 4/1967 | Garwood | 271/30 A |

*Primary Examiner*—Bruce H. Stoner, Jr.
*Attorney, Agent, or Firm*—Shenier & O'Connor

[57] ABSTRACT

Apparatus for successively delivering envelopes from a stack of envelopes arranged on edge on a support to a conveyor belt disposed below one edge of the support. The stack is urged by a driven feeder into engagement with an abutment extending across and slightly above the support adjacent to the support edge and into engagement with a retainer bar spaced above the support by a distance somewhat less than the height of the smallest envelope to be handled. A suction device first engages the leading envelope of the stack to pull it over the abutment and then to pull the lower edge forwardly over a stripper element to ensure that any envelope stuck to the leading envelope is stripped therefrom. Subsequently, the suction device moves downwardly to pull the leading envelope out from under the retainer bar and then releases it to permit it to fall to the conveyor. The driven feeder provides a controlled force for urging the envelopes against the abutment and the retainer bar.

19 Claims, 14 Drawing Figures

MULTIPLE SIZE ENVELOPE FEEDER

BACKGROUND OF THE INVENTION

Our invention relates to apparatus for successively delivering envelopes to a delivery surface and, more particularly, apparatus for use in combination with other subassemblies of an envelope opening machine.

In the copending application of Frederick N. Stephens, applicant Glenford Rowlett, and James. D. Beard, Ser. No. 608,847, filed Aug. 29, 1975, there was described an envelope opening apparatus in which envelopes are discharged successively from a feeder to a conveyor belt and are subsequently carried to a breaking station at which the side edges of the envelopes are broken open and to a stacking station at which the envelopes are temporarily stored until the operator can remove the envelope contents. In the feeder portion of the apparatus, envelopes are retained in a vertical stack on a support having a discharge edge above the conveyor belt. The stack is urged against an upwardly extending retaining lip formed at the support edge and a transverse high-friction roller spaced above the support edge and the retaining lip. Envelopes are individually supplied to the conveyor belt from the support edge by moving a suction cup against the leading envelope of the stack at a point below the transverse roller to grip the envelope. The suction cup is then moved away from the stack to pull the lower edge of the leading envelope over the lip. Next, the suction cup is disabled and the roller is rotated in a direction to drive the leading envelope downwardly away from the stack to feed rollers which deliver it to the conveyor belt.

While the arrangement described above is capable of supplying intermixed envelopes of varying sizes to a conveyor belt or other delivery surface, it may not effectively separate the leading envelope from that immediately therebehind so that the danger exists of two envelopes being fed together to the conveyor. That is, stripping of the lead envelope from the stack is not positive. Two envelopes which are stuck together, for example, may be fed to the conveyor together and thus lead to jamming of the mechanism or destruction of a piece of mail. Moreover, the feeder itself may jam when the leading envelope clings to a subsequent envelope and fails to adhere to the roller as it is rotated to move the envelope downwardly. Although the gripping action of the roller can be improved by providing it with a high-friction surface, the grip between the roller and the envelope is not positive and can be defeated by envelopes that cling together.

SUMMARY OF THE INVENTION

One of the objects of our invention is to provide an apparatus for successively delivering envelopes from a stack.

Another object of our invention is to provide an apparatus which minimizes the possibility of delivering two or more envelopes at one time.

Still another object of our invention is to provide an apparatus having a positive and reliable delivery.

A further object of our invention is to provide an apparatus in which envelopes are retained under a controlled force prior to delivery.

Other and further objects will become apparent from the following description:

In general our invention contemplates an apparatus in which a stack of envelopes arranged on edge on a support is urged into engagement with an abutment extending across and slightly above the support adjacent to an edge thereof and into engagement with a retainer bar spaced above the support by a distance somewhat less than the height of the smallest envelope to be handled. A suction device first engages the leading envelope of the stack to pull it over the abutment and then to pull the lower edge forwardly over a stripper element to ensure that any envelope stuck to the leading envelope is stripped therefrom. Subsequently, the suction device moves downwardly to pull the leading envelope out from under the retainer bar and then releases it to permit it to fall to a conveyor spaced below the support edge.

We have found that this arrangement substantially reduces the possibility of feeding two or more envelopes to the conveyor at one time. The movement of the suction device is such that any envelope which may have stuck to the leading envelope as it is moved over the abutment is effectively stripped from the leading envelope as they are moved over the stripper element. Further, this arrangement provides an improved separation of the leading envelope from the upper retainer member. The leading envelope is firmly held by the suction device as it is moved downward. Since the tractive force of the suction device is many times greater than the frictional force capable of being generated by a rotating high-friction roller, the possibility of misfeed due to clinging to a second envelope is significantly reduced.

In another aspect, our invention contemplates means for providing a controlled force to urge the stack of envelopes against the abutment and the retainer bar. More particularly, the support is formed with a pair of spaced parallel slots running toward the discharge edge. A pair of screws are disposed in the slots below the support. A vertical pressure plate extending between the slots is movable in the direction of the support edge and has a pair of runners extending into the slots to engage the threads of the screws. The screws are rotated in such a direction as to move the pressure plate toward the support edge and thus urge the envelope against the abutment and retainer bar. In a preferred form of the invention, means are provided for disabling the screw rotating means whenever the stack of envelopes presses against the abutment with a predetermined force.

BRIEF DESCRIPTION OF THE DRAWINGS

In the accompanying drawings which form part of the instant specification and which are to be read in conjunction therewith and in which like reference numerals are used to indicate like parts in the various views.

DETAILED DESCRIPTION OF THE PREFERRED EMBODIMENT

Figure 1:
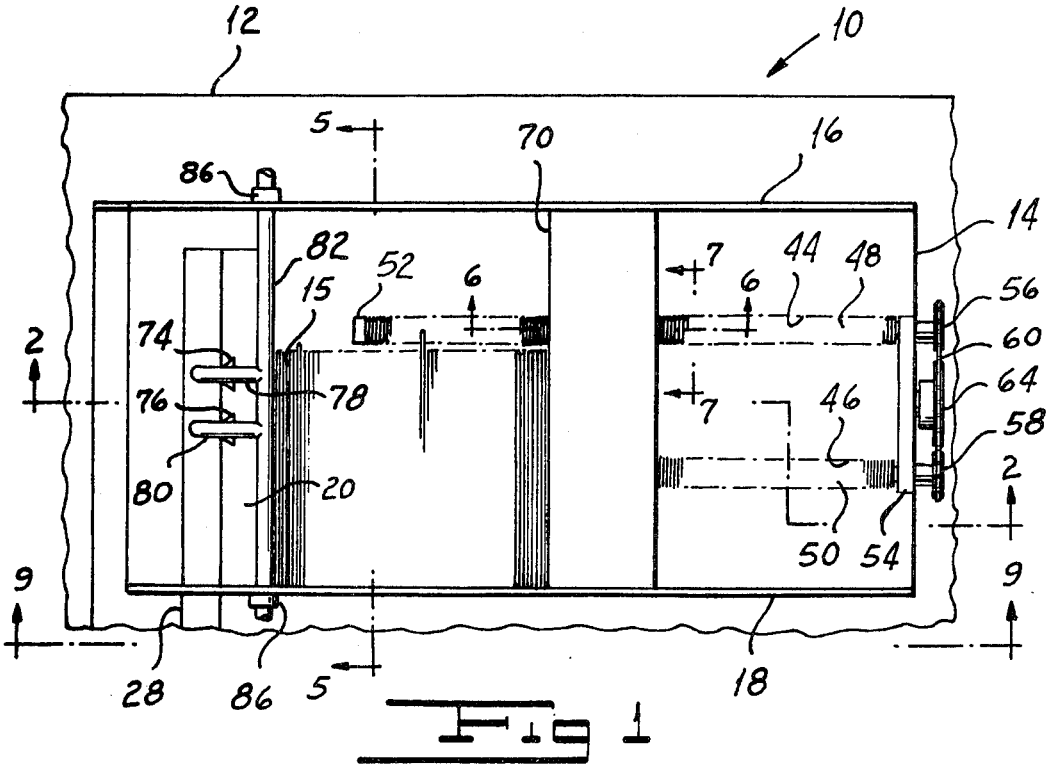
FIG. 1 is a fragmentary top plan of our envelope feeder.
Figure 2:
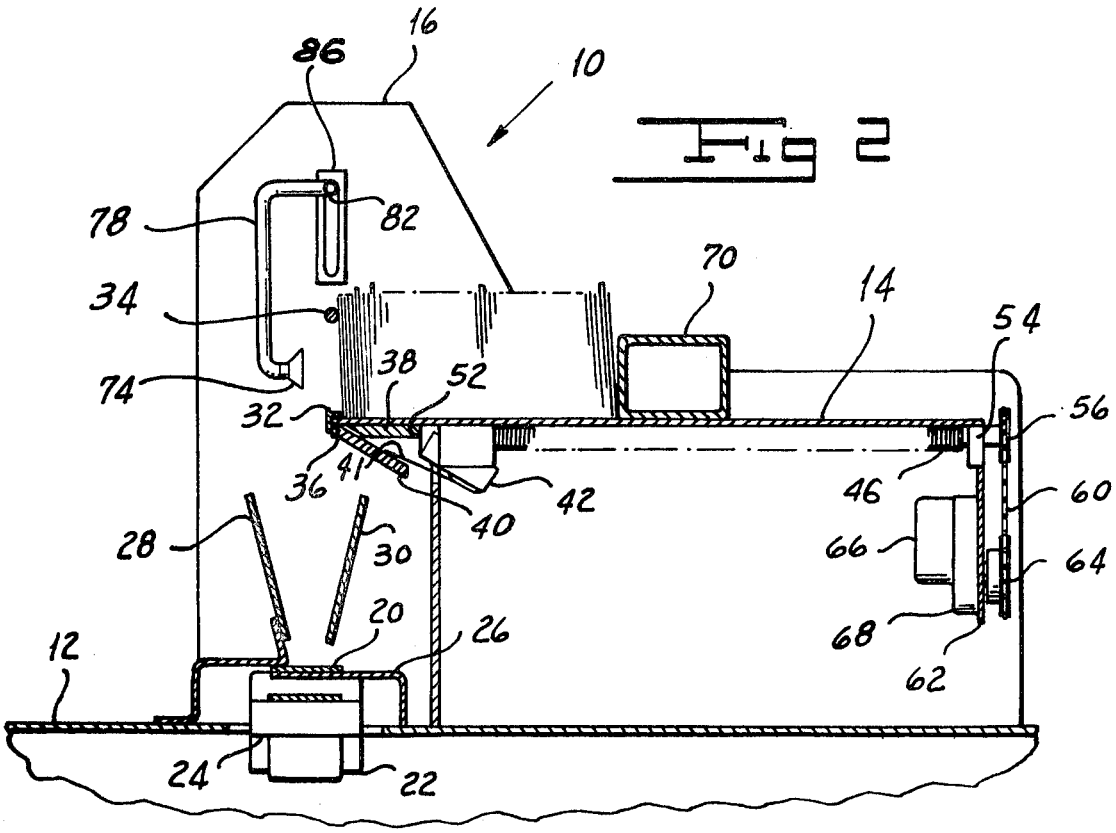
FIG. 2 is a fragmentary section of the feeder shown in FIG. 1, taken along line 2—2.

Referring to the drawings, our envelope feeder, indicated by the reference numeral 10, rests on a horizontal base 12. The base also supports the breaking and stacking assemblies described in the copending application Ser. No. 608,847, hereby incorporated by reference. The feeder 10 includes a generally horizontal support 14 for receiving a stack of envelopes 15 arranged on edge. The envelopes forming the stack 15 need not be aligned with one another and may vary in length or in height. The support 14 is disposed between a pair of vertical side panels 16 and 18 so that its front edge overhanges a conveyor belt 20. Pulleys 22 and 24 support one end of the conveyor belt 20, which provides a delivery surface for envelopes supplied from the feeder 10. A suitable means (not shown) continuously moves the conveyor belt 20 in the direction shown in FIG. 3. A supporting plate 26 supports the belt 20 along its upper run. Envelopes supplied to the belt 20 from the feeder 10 are kept in an upright position by guide walls 28 and 30 which extend along the length of the belt 20 and lean outwardly toward their tops so as to form a V, as seen in FIG. 2.

A lower retainer member 32 having portions disposed slightly above the support adjacent to its front edge and an upper retainer member 34 spaced above the lower retainer member 32 support the leading end of the stack of envelopes 15. The lower retainer member 32 has a rear abutment 31, behind which the envelopes are normally maintained, and an upwardly extending lip 33 spaced ahead of the rear abutment 31. The lip 33 serves as a stripper element for separating any envelope which may have stuck to the leading envelope when it is pulled over the rear abutment 31. The upper retainer member 34, preferably a transverse cylindrical bar such as shown, is spaced from the support 14 by a distance somewhat less than the height of the smallest envelope to be handled. A pin 36 pivotally mounts the lower retainer member 32 to a transverse supporting member 38 disposed beneath the front edge of the support 14. An arm 40 which is integral with the member 32 extends generally rearwardly and slightly downwardly from the pivot pin 36 to engage an actuator member 41 of a normally closed switch 42. Pressure of the envelope stack 15 against the lower retainer member 32 causes the arm 40 to swing upwardly to actuate the switch 42.

A pair of spaced parallel slots 44 and 46 extend from the rear of the support 14 toward the front edge thereof. Respective screws 48 and 50 extend along the slots just beneath the support surface 14. A pair of low-friction bearing blocks 52 rotatably receive unthreaded portions of the screws 48 and 50 at the front of the feeder 10. A single bearing block 54 rotatably receives unthreaded portions of the screws 48 and 50 at the rear of the feeder. The rear unthreaded portions of screws 48 and 50 extend behind the rear bearing block 54 to receive respective sprocket wheels 56 and 58. A chain 60 couples sprocket wheels 56 and 58 to a third sprocket wheel 64 which is coupled to a motor 66 through a gear box 68.

Figure 8:
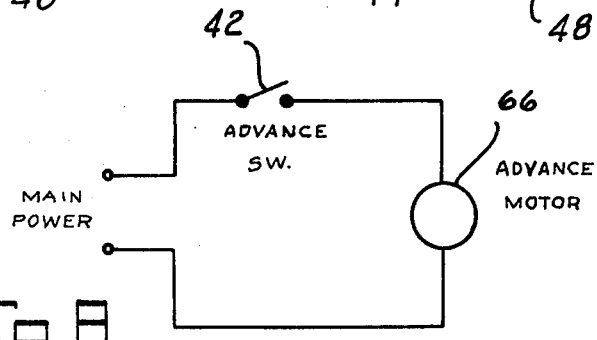
FIG. 8 is a schematic view of the screw motor control circuit for the feeder shown in FIG. 1.

An elongated rectangular pressure plate 70 urges the stack of envelopes 15 against the upper and lower retainer members 32 and 34. The pressure plate 70 may comprise a suitably stamped piece of metal, as shown, or may comprise a solid block of metal or other material. Pressure plate 70 has a pair of threaded runners 72 which extend into the slots 44 and 46 to engage the threads of the screws 48 and 50. Motor 66 intermittently drives the screws 48 and 50 to move the pressure plate 70 forward so as to urge the stack of envelopes against the lower and upper retainer members 32 and 34. As the stack 15 presses against the lower retainer member 32, the actuator arm 40 pivots upwardly so as to open the switch 42, turning off the motor 66 (See FIG. 8). When the pressure of the leading envelope against the lower retainer member 32 drops below a predetermined value after envelopes have been delivered to the conveyor belt 20, actuator arm 40 falls downwardly so as to permit switch 42 to reclose, turning on motor 66. The motor 66 then drives the screws 48 and 50, moving pressure plate 70 forward until sufficient pressure of the envelopes against the lower retainer member 32 causes actuator arm 40 to move upwardly to reopen switch 42. In this manner, pressure plate 70 urges the stack of envelopes 15 against the lower retainer member 32 and the upper retainer member 34 with a controlled force without using such devices as springs or inclined surfaces which may complicate the loading step.

Figure 4:
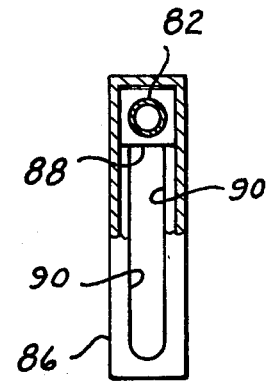
FIG. 4 is an enlarged side elevation, shown partly in section, of one of the guide members for the cup arm pivot shaft of the feeder shown in FIG. 1.
Figure 5:
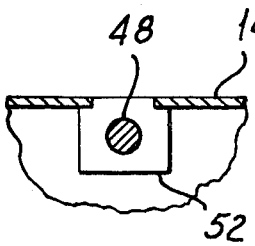
FIG. 5 is a fragmentary section of the screw support means at the front end of the feeder shown in FIG. 1, taken along line 5—5.
Figure 6:
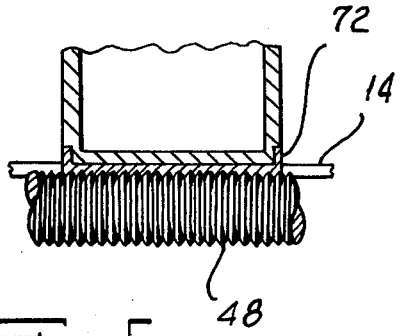
FIG. 6 is an enlarged fragmentary section of one of the runners of the pressure plate shown in FIG. 1, taken along line 6—6.
Figure 7:
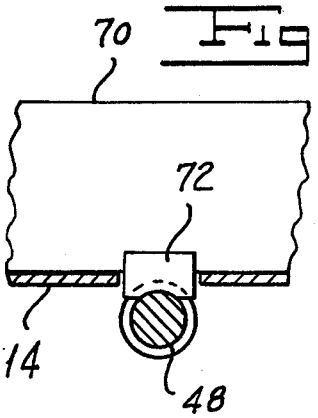
FIG. 7 is an enlarged fragmentary section of one of the runners of the pressure plate shown in FIG. 1 and associated assembly, taken along line 7—7.

Envelopes are removed from the front of the stack of envelopes by a pair of suction cups 74 and 76 which are laterally spaced so as to be on opposite sides of the lower retainer member 32 and are vertically disposed between the front edge of the support 14 and the upper retainer member 34. We space each of the cups 74 and 76 from the more distant side panel 16 or 18 by a distance somewhat less than the length of the smallest envelope to be handled to ensure that the cups will grip such an envelope regardless of its lateral alignment. Respective arms 78 and 70 attached to a horizontal pivot shaft 82 support suction cups 74 and 76. Pivot shaft 82 in turn is located between the side panels 16 and 18 by means of slot-forming guide members 86. Referring to FIG. 4, each of the guide members 86 receives a block 88 for vertical sliding movement therein. Each block 88 in turn rotatably supports the pivot shaft 82 which extends through a slot 90 formed in the guide member 86. An extension of the pivot shaft 82 past side panel 18 receives one end of a cam arm 94 for rotation therewith. A spring 97 urges a cam follower 96 on the other end of the cam arm 94 against a butterfly cam 98.

A shaft 100 rotating one revolution per cycle of operation supports cam 98.

Figure 14:
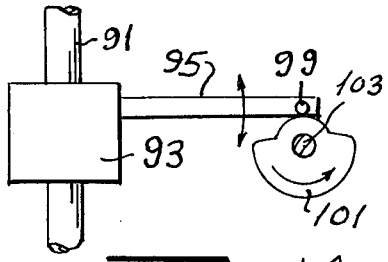
FIG. 14 is a fragmentary view of the vacuum line control means.
Figure 12:
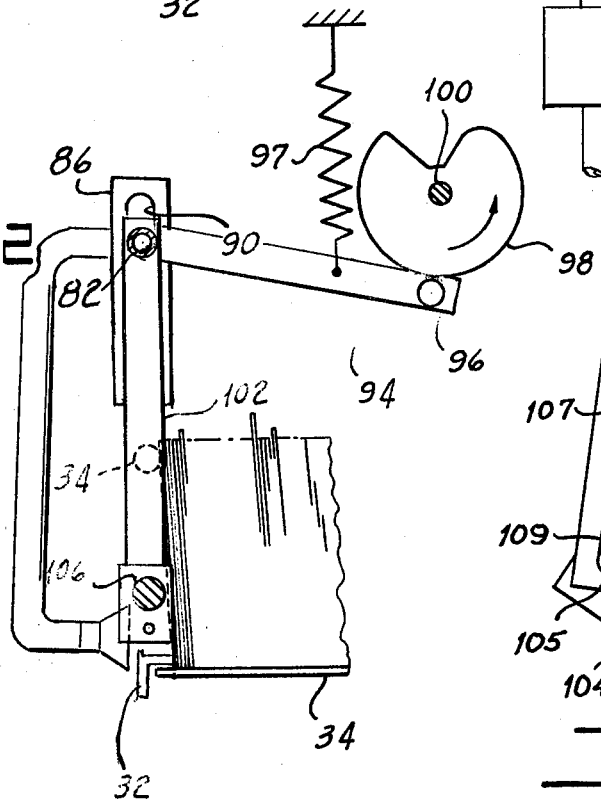
FIG. 12 is a view of the feeder portions shown in FIG. 9 at a still further advanced stage in the operating cycle.
Figure 13:
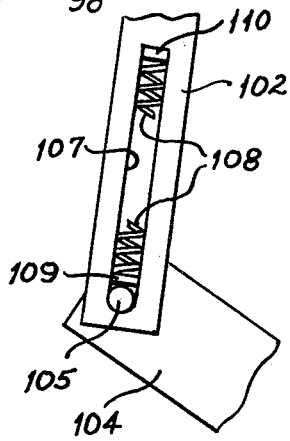
FIG. 13 is a fragmentary side elevation of the coupling between the eccentric and the reciprocating arm of the feeder.

A line 91 controlled by a dump valve 93 (FIG. 14) couples a vacuum supply 92 to the pivot shaft 82 at any suitable point, such as at an end, to provide the cups 74 and 76 with a vacuum. An actuator arm 95 in turn controls the dump valve 93. A cam follower 99 provided at the end of the actuator arm engages a cam 101. A shaft 103 rotates the cam 101 at the rate of one revolution per cycle of operation.

Figure 3:
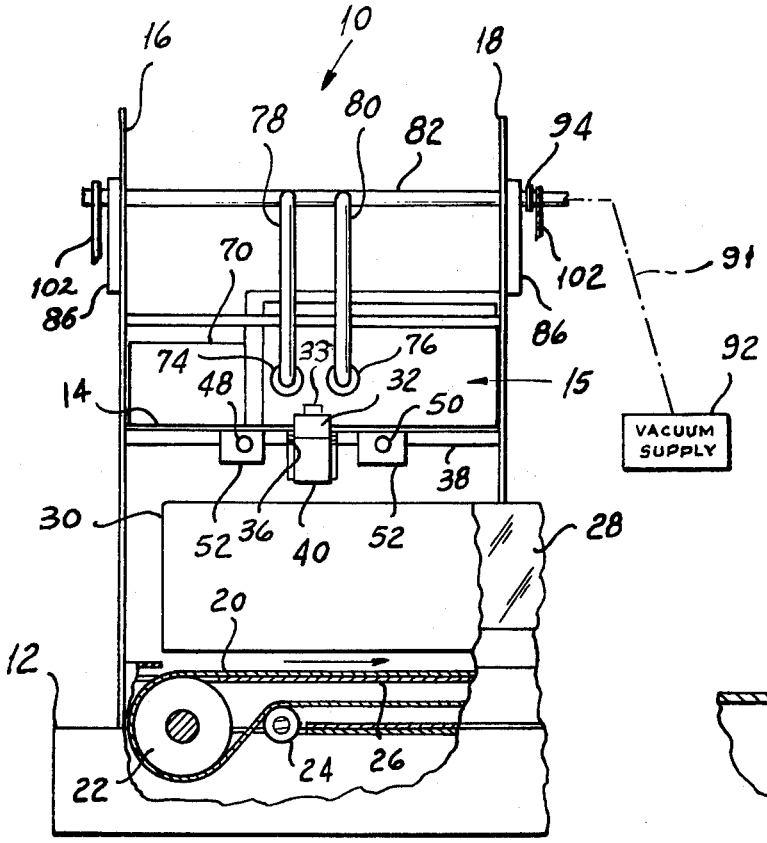
FIG. 3 is a fragmentary front elevation, shown partly in section, of the feeder shown in FIG. 1.

Pivot shaft 82 also receives, preferably at each end thereof (FIG. 3), a link arm 102 for providing reciprocating vertical movement. In the following description, reference will be made to the link arm to the right of side panel 18, as seen in FIG. 3. It is to be understood, however, that the left-hand link arm 102 is coupled to an identical assembly and operates in an identical manner. Referring particularly to FIGS. 9–13, a longitudinal slot 107 formed at the lower end of link arm 102 receives a pin 105 carried by an eccentric 104. The eccentric 104 is supported by a shaft 106. A compression spring 108 supported at its lower end by a slider element 109 and at its upper end by a fixed retainer member 110 biases the eccentric pin 105 toward the lower end of the slot 109. The eccentric shaft 106 rotates in the direction shown at the same angular speed as shaft 100 — that is, at one revolution per cycle of operation.

Figure 9:
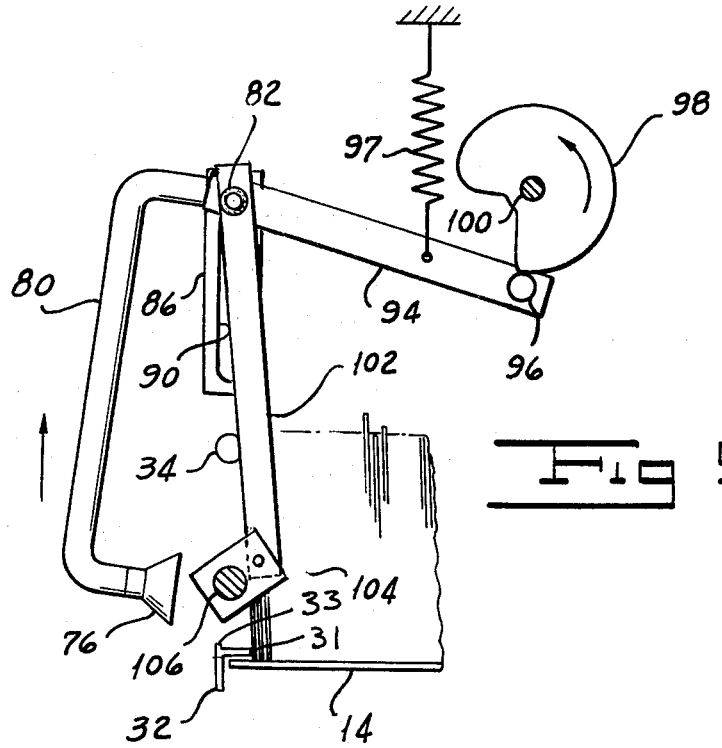
FIG. 9 is an enlarged section, taken along line 9—9 of FIG. 1, of the feeder shown in FIG. 1, with parts omitted.
Figure 10:
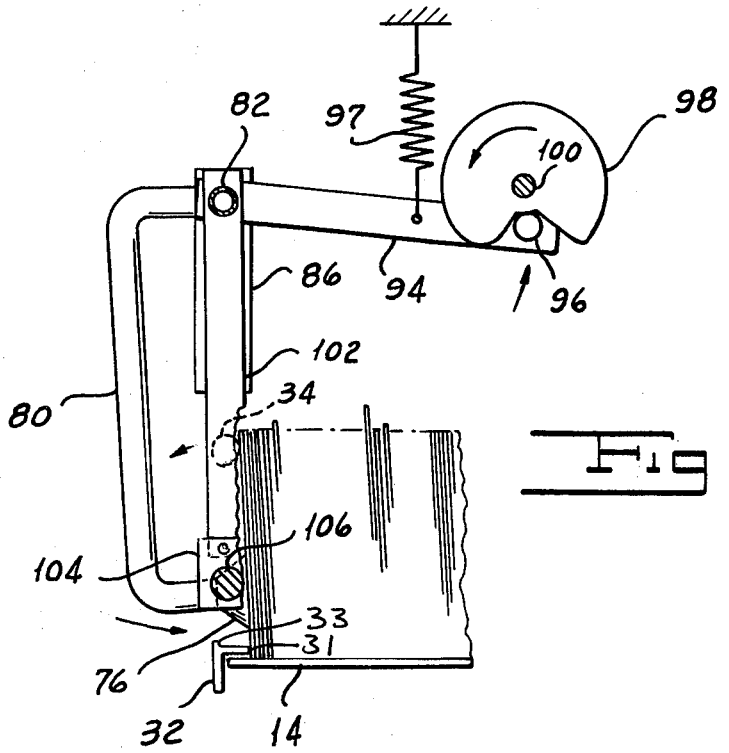
FIG. 10 is a view of the feeder portions shown in FIG. 9 at an advanced stage in the operating cycle.
Figure 11:
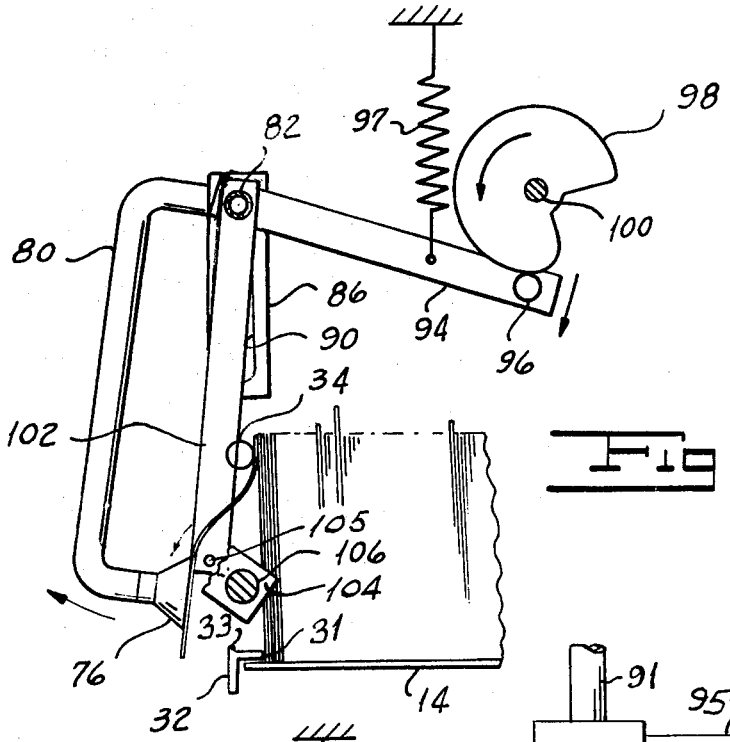
FIG. 11 is a view of the feeder portions shown in FIG. 9 at a further advanced stage in the operating cycle.

At the beginning of a given cycle of operation — or, equivalently, at the end of the preceding cycle of operation — the feeder is in the configuration shown in FIG. 9. Eccentric 104 has rotated to a sufficiently high point to move the pivot shaft 12 to its uppermost position within the slot-forming members 86. The spring 108 allows the shaft 82 to dwell in this position until the eccentric 104 reaches the corresponding point on the downward portion of its rotation. Cam 98 has reached a point where the cam follower 96 is still engaging the outer portion of the cam so as to maintain the cups 74 and 76 in a position away from the stack of envelopes 15.

Immediately following the stage of operation shown in FIG. 9, cam follower 96 begins to swing upwardly against the inner portion of the cam 98 to swing the cups 74 and 76 toward the stack of envelopes 15. Eccentric 104 continues to swing upwardly while the pivot shaft 82 dwells in its upper position. At the same time, cam 101 advances to a point at which it deactuates dump valve 93 to supply the cups 74 and 76 with a vacuum. At the stage of operation shown in FIG. 10, cups 74 and 76 have moved fully inward to a position in which they grip the leading envelope of the stack 15. Also at this stage, the eccentric 104 has rotated to its uppermost position.

Immediately thereafter, cam follower 96 begins to swing toward the outer rim of the cam, causing the cups 74 and 76 to swing away from the envelope stack 15 to carry the leading envelope over the abutment 31 and the lip 33. The stripper lip 33 separates any envelope which may have stuck to the leading envelope and moved over the rear abutment 31. Because the trailing edge of the cam 98 is more gradually sloped than its leading edge, cups 74 and 76 move away from the stack 15 relatively slowly so as not to lose their grip on the leading envelope. At the same time, the eccentric 104 begins to rotate downwardly. At the stage shown in FIG. 11, cups 74 and 76 have moved all the way out from the stack 15, while the eccentric 104 has reached a position at which the pivot shaft emerges from its dwell period. Eccentric 104 continues to rotate downwardly, causing pivot shaft 82 and cups 74 and 76 to move downwardly and pull the leading envelope away from the upper retainer member 34. When eccentric 104 and the cups 74 and 76 reach their lowermost point, shown in FIG. 12, cam 101 advances to a position at which it actuates dump valve 93 to disable the suction cups 74 and 76 so that the envelope is allowed to fall to the delivery surface provided by the conveyor belt 20. Thereafter, the eccentric 104 begins to rotate upwardly to move the pivot shaft 82 and the cups 74 and 76 to the position shown in FIG. 9. The feeder is now ready to begin a new cycle of operation similar to the one just described.

We have thus accomplished the objects of our invention. Our apparatus reliably separates the leading envelope so as to prevent the feeding of more than one envelope at a time. Further, our apparatus removes the leading envelope from the stack with a positive separating action to ensure that the envelope is actually fed and that the feeder will not jam.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claims is:

1. Apparatus for supplying envelopes one at a time from a stack of envelopes arranged on edge including, in combination: first and second spaced retainer members for retaining one end of said stack; an arm having a suction device mounted at one and thereof; a pivot shaft supporting the arm at the other end for pivotal movement thereof; means for providing a slot slidably receiving said pivot shaft; and means for sequentially moving said pivot shaft along said slot in one direction to move the suction device adjacent to said one end of said stack, rotating said shaft in such a direction as to move said suction device into engagement with said one end of said stack to grip the leading envelope, rotating said shaft in the opposite direction to separate said leading envelope from said first retainer member, and then moving said pivot shaft along said pivot shaft slot in the opposite direction to separate said leading envelope from said second retainer member, said moving means including a drive shaft having an eccentric mounted thereon, means coupling the eccentric to the pivot shaft, a cam shaft having a cam mounted thereon, a follower arm having one end fixedly attached to said pivot shaft, and means urging the follower arm against the cam.

2. Apparatus as in claim 1 in which the second retainer member is cylindrical.

3. Apparatus as in claim 1 in which the moving means moves the suction device into engagement with the leading envelope relatively rapidly and moves the device away from the stack relatively slowly.

4. Apparatus as in claim 1 in which said cam is so shaped as to move the suction device into engagement with the leading envelope relatively rapidly and to move said device away from the stack relatively slowly.

5. Apparatus as in claim 1 including a support for receiving said stack of envelopes, said support having an edge.

6. Apparatus as in claim 5 in which the second retainer member extends parallel to the support edge.

7. Apparatus as in claim 1 including means for urging said one end of said stack of envelopes against the first and second retainer members.

8. Apparatus as in claim 7 in which the urging means comprises a pressure plate and means including a feed screw for moving the pressure plate.

9. Apparatus as in claim 8, further including means for driving the feed screw and means responsive to a predetermined force on the first retainer member for disabling the driving means.

10. Apparatus as in claim 9 including a support for receiving said stack of envelopes, said first member being disposed near an edge of said support, said disabling means comprising means mounting said first retainer member for rotation about an axis parallel to said support edge and means applying a predetermined bias torque to the first retainer member.

11. Apparatus as in claim 1 in which said suction device is normally enabled, said apparatus including means for disabling said suction device to release said leading envelope.

12. Apparatus as in claim 11 in which the moving means and the disabling means operate cyclically to supply envelopes successively from the stack.

13. Apparatus as in claim 1 including a support for receiving said stack of envelopes, said first retainer member comprising a lower retainer member relatively closely spaced to said support, said second retainer member comprising an upper retainer member relatively distantly spaced from said support.

14. Apparatus as in claim 13 in which the lower retainer member comprises a primary abutment and an upwardly extending lip providing a secondary stripping abutment.

15. Apparatus as in claim 1 in which said suction device comprises a first suction cup, said apparatus further including a second suction cup spaced from said first suction cup.

16. Apparatus as in claim 1 in which said pivot shaft extends generally horizontally.

17. Apparatus as in claim 16 in which said arm extends generally vertically, said suction device being mounted at the lower end of said arm.

18. Apparatus for supplying envelopes one at a time from a stack of envelopes arranged on edge including, in combination: first and second spaced retainer members for retaining one end of said stack; an arm having a suction device mounted at one end thereof; a pivot shaft supporting the arm at the other end for pivotal movement thereof; means for providing a slot slidably receiving said pivot shaft; and means for sequentially moving said pivot shaft along said slot in one direction to move the suction device adjacent to said one end of said stack, rotating said shaft in such a direction as to move said suction device into engagement with said one end of said stack to grip the leading envelope, rotating said shaft in the opposite direction to separate said leading envelope from said first retainer member, and then moving said pivot shaft along said slot in the opposite direction to separate said leading envelope from said second retainer member, said moving means including a drive shaft having a eccentric mounted thereon, means coupling the eccentric to the pivot shaft, means for limiting the movement of said pivot shaft along said slot in said one direction during an appreciable portion of the rotation of said eccentric, a cam, an arm having one end fixedly mounted on the pivot shaft, and means for urging the arm against the cam.

19. Apparatus for supplying envelopes one at a time from a stack of envelopes to a delivery surface, including in combination: a support for receiving said stack of envelopes, said support having an edge disposed above the delivery surface; a lower retainer member disposed slightly above said support edge; an upper retainer member disposed appreciably above said lower retainer member; means for urging the stack of envelopes in such a direction that a leading envelope bears against the upper and lower retainer members; a vertically extending pivot arm; a suction cup mounted at the lower end of said arm; a horizontal pivot shaft supporting said pivot arm; means for sequentially rotating the pivot shaft in one direction to move the suction cup into engagement with the leading envelope of the stack, rotating the shaft in an opposite direction to move the suction cup away from the stack, and moving the shaft downwardly to pull the leading envelope away from the upper retainer member; and means for disabling the suction device to permit the envelope to fall to the delivery surface, said moving means comprising means for providing a pair of vertically extending slots, said pivot shaft being slidably mounted in said slots, a drive shaft, an eccentric mounted on the drive shaft, and means including a link arm for coupling the eccentric to the pivot shaft, said eccentric coupling means comprising a resilient member, the construction being such that the slots limit upward movement of the pivot shaft in the region of top dead center of the eccentric.

* * * * *